United States Patent [19]

Hess et al.

[11] Patent Number: 4,888,916

[45] Date of Patent: Dec. 26, 1989

[54] DRIVE ARRANGEMENT FOR A WINDOW LIFTING MECHANISM

[75] Inventors: Hans-Peter Hess; Peter Hlousek, both of Coburg, Fed. Rep. of Germany

[73] Assignee: Brose Fahzeugteile GmbH & Co. Kommanditgesellschaft, Coburg, Fed. Rep. of Germany

[21] Appl. No.: 233,666

[22] Filed: Aug. 18, 1988

[30] Foreign Application Priority Data

Aug. 24, 1987 [DE] Fed. Rep. of Germany ..... 8711470

[51] Int. Cl.[4] ..... E05F 11/48

[52] U.S. Cl. ..... 49/352

[58] Field of Search ..... 49/352, 349, 348, 350, 49/351, 374, 222

[56] References Cited

U.S. PATENT DOCUMENTS 4,423,566 1/1984 Hess et al. ..... 49/352

4,759,653 7/1988 Maekawa et al. ..... 49/352 X

*Primary Examiner*—Philip C. Kannan

*Attorney, Agent, or Firm*—Toren, McGeady & Associates

[57] ABSTRACT

A driver for a window lifter, particularly in a motor vehicle, including at least one slider pair for guiding a leg of a guide rail section, which leg extends in the direction of the plate plane, wherein each slider is formed by at least one sheet metal tab which is bent out of the plate plane of a driver plate and covered with an injection molded material, the two sheet metal tabs of the two sliders are connected with one another by means of a sheet metal web which is bent out of the plate plane, with a bending edge shared by the two sheet metal tabs and the sheet metal web.

7 Claims, 1 Drawing Sheet

DRIVE ARRANGEMENT FOR A WINDOW LIFTING MECHANISM

BACKGROUND OF THE INVENTION

The innovation relates to a driver plate for a window lifter, particularly in a motor vehicle, comprising at least one slider pair for guiding a leg of a guide rail section extending in the direction of the plate plane, wherein each slider is formed by at least one sheet metal tab which is bent out of the plate plane of a driver plate and provided with an injection mold.

Such a driver plate is known from DE-OS 30 23 641. As shown in FIGS. 1 and 7, two such slider pairs 34, 36 and 34' and 36' can be provided. Between the sheet metal tabs 40 and 46, which are bent upward, the driver sheet-metal plate is provided with an approximately ear-shaped punched out portion which is open toward the rim of the sheet metal plate, situated in the plane of the sheet metal plate and obviously serves to obtain clean bending edges of the two sheet metal tabs. As a result of this known arrangement, the driver plate is constructed so as to be substantially planar in the area between the two slider pairs, and there is, accordingly, a certain risk of deformation. When there are forces occurring during operation and acting between the guide rail and the sliders which attempt to bend the sliders of a slider pair away from one another, the driver plate can be bent around a bending edge extending between the two slider pairs.

SUMMARY OF THE INVENTION

The object of the innovation consists in increasing the bending resistance of the driver plate in the region of the sliders.

This object is met in that the two sheet metal tabs of the two sliders are connected with one another by means of a sheet metal web, which is bent out of the plate plane, with a bending edge common to the two sheet metal tabs as well as to the sheet metal web. This sheet metal web forms a bent-around stiffening rim for the driver plate in the critical area between the sliders. The sheet metal web forms the middle leg of a sheet metal part which is cut in a substantially U-shaped manner and is bent around the bending edge, wherein the side leg of the U shape is formed by the two sheet metal tabs. In this way, forces occurring during operation and acting on the sheet metal tabs are, for the most part, transmitted directly from one sheet metal tab to the other sheet metal tab via the web without the driver plate being loaded to a great extent. In order to be able to advance the guide rail as close as possible to the driver plate (reduced installation space requirement and reduction of the tilting moments acting on the sliders), the height of the web should be selected so as not to be too great. A web height which substantially corresponds to the sheet metal thickness of the driver plate has proven sufficient with respect to the desired stiffness of the driver in the slider area.

In a further development of the innovation it is suggested that the sheet metal web be covered with an injection molded material. This injection molded material can continue into the injection molded materials of the two sheet metal tabs so as to form one piece, which provides for a good holding together of the sheet metal plate and injection mold. The injection molded material of the sheet metal web can simultaneously serve as a low-friction guide surface for the rim of the leg of the guide rail section, which leg is guided in the slider pair.

In a further development of the innovation, it is suggested that at least one of the two sliders be strengthened by means of another sheet metal tab which is bent out of the plate plane. In a particularly preferred manner it is provided that the bending edge of the additional sheet metal tab extend substantially parallel to the bending edge of the sheet metal web. The stiffening by means of the additional sheet metal tab is particularly effective, since the additional sheet metal tab is also oriented transversely relative to the predominantly occurring forces attempting to spread apart the sliders of a slider pair. The additional sheet metal tab 48 known from the aforementioned DE-OS 30 23 641 is orientated transversely relative to this and can therefore be bent more easily.

In addition, it is suggested that the one slider and the additional sheet metal tab be covered with an injection molded material together.

BRIEF DESCRIPTION OF THE DRAWING

The innovation is explained in the following by way of a preferred embodiment example with the aid of the drawing.

DETAILED DESCRIPTION OF THE PREFERRED EMBODIMENT

Figure 1:
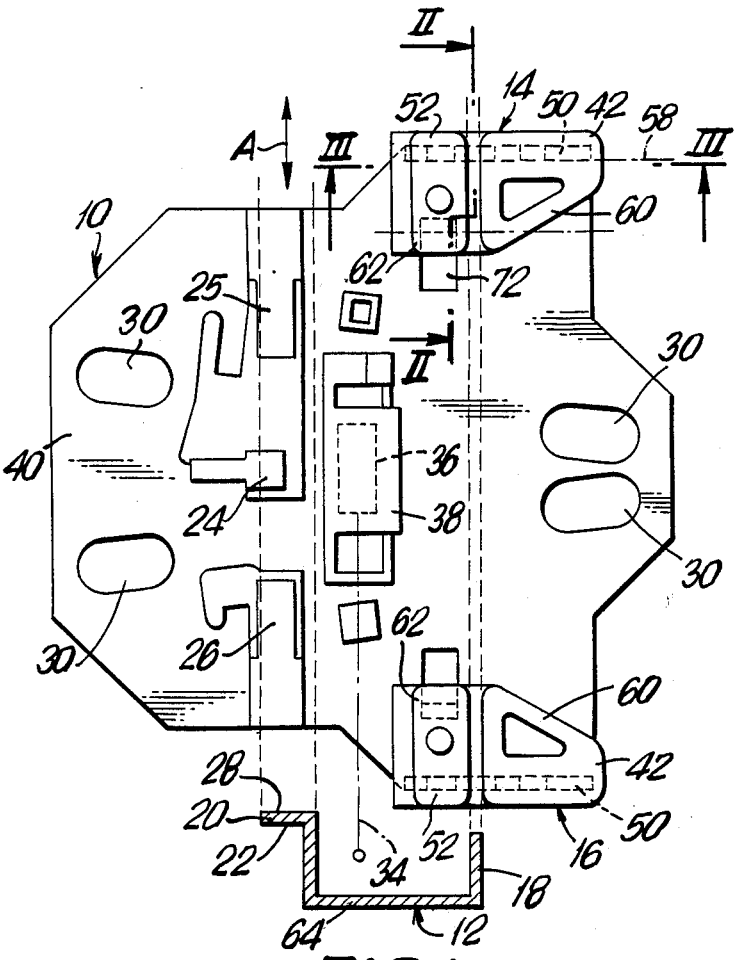
FIG. 1 shows a side view of a driver, constructed according to the innovation, for a rope window lifter.

The driver 10, according to FIG. 1, corresponds to a great extent in design and function to the driver shown and described in DE-OS 30 23 641. It is guided along a guide rail 12 having a Z-U-section shape so as to be displaceable in a reciprocating manner in its longitudinal direction. A slider pair 14, which can be seen in FIG. 1 at the upper end of the driver 10, as well as a corresponding slider pair 16 at the lower end of the driver serve to guide a leg 18 of the guide rail 12, which leg 18 is directed toward the plane of the plate-shaped driver 10. An edge strip 20 of the guide rail 12 at the other rim of the guide rail 12 is bent down parallel to the plate plane and lies with its upper side 22 at the lower side of a guide angle 24, its upper side 22 being remote of the driver 10; tongue springs 24, 26, which act at the underside 28 of the edge strip 20, press the edge strip 20 against this guide angle 24.

The windowpane to be moved by the window lifter can be connected with the driver 10 in the usual manner; elongated holes 30, which are indicated in FIG. 1, serve to receive corresponding fastening means.

According to the type of force transmission means employed, e.g. the lifting arm of a rod-linkage window lifter or a screw cable of a screw cable window lifter can act at the driver 10. In the shown embodiment example, the driver 10 is part of a rope window lifter. In FIG. 1, a pulling rope 34 is indicated with a dash-dot line, its ends proceeding from a rope nipple 36, indicated in dots, within a rope nipple chamber 38 as part of the driver 10.

The driver 10 is formed by a substantially planar or, corresponding to the guide rail, slightly curved driver plate 40 which is provided with punched out portions, particularly the elongated holes 30, as well as with a series of plastics parts which are injection molded on, particularly the two tongue springs 26 and the nipple chamber 38. The two slider pairs 14 and 16 are also formed by having a material injection molded thereon or therearound 42. In order to increase the mechanical stiffness and improve the holding together of the respective injection mold material 42 with the sheet metal driver plate 40, sheet metal tabs, which are bent out of the plate plane, are located inside the injection mold material 42. In order to additionally strengthen the cohesion, these sheet metal tabs are provided with through-holes 46 which are filled with injection molding material.

Figure 3:
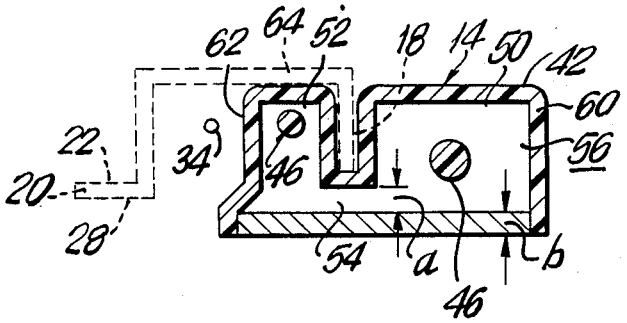
FIG. 3 shows a detail section according to line III—III in FIG. 1.

The chief stiffening of the slider pair is effected in each instance by means of two sheet metal tabs 50, 52 which are connected with one another by means of a sheet metal web 54, so as to provide the general U shape of the sheet metal part 56, which can be seen, for example, in FIG. 3, the sheet metal part 56 being formed by these two sheet metal tabs 50 and 52 and the sheet metal web. In a single bending process, the sheet metal part 56 is bent around the bending edge 58 which is indicated in FIG. 1 and is perpendicular to the rail longitudinal direction A of the guide rail 12 and parallel to the plate plane. The web height a corresponds substantially to the sheet metal thickness b (FIG. 3).

Figure 2:
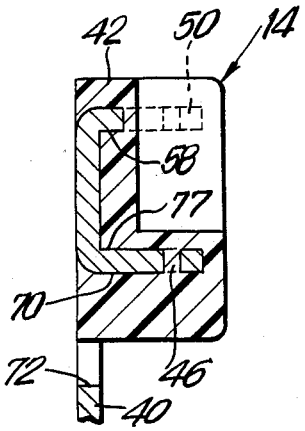
FIG. 2 shows a detail section according to line II—II in FIG. 1.

Every slider pair 14 comprises an outer slider 60 and an inner slider 62. As already mentioned, the two sliders 60 and 62 are connected with one another via the sheet metal web 54, as well as via the injection mold material 42 covering both the two sheet metal tabs 50 and 52 and the sheet metal web 54. The outer slider 60 contacts the outside of the leg 18 of the guide rail and, accordingly, the inside of the inner slider 62. In addition, the middle leg 64 of the guide rail 12, which follows the leg 18, contacts the upper side of the inner slider 62 with its inside. Accordingly, guidance forces, which are also accordingly greater, act on the inner slider 62. For this reason, the inner slider 62 is strengthened by means of an additional sheet metal tab 70 which is bent out of the plate plane and is indicated in section in FIG. 2. The punching opening 72 left behind from the bent out sheet metal tab 70 can be seen in the driver plate 40. The bending edge 77 of the sheet metal tab 70 extend parallel to the bending edge 58, specifically at the rim of the rectangular punched out portion 72 facing the sheet metal tab 52. The area of the driver plate 40 between the sheet metal tabs 50 and 70 is therefore not weakened by any punched out portion. The sheet metal tab 70 has the same contour shape as the sheet metal tab 50 and is offset relative to the latter in the direction of the guide rail.

We claim:

1. A driver (10) for a window lifting mechanism, comprising:

a driver plate (40) having a plate plane;

a guide rail (12) having a section with a leg (18) arrange to extend in the direction of the plate plane; and at least one slider pair (14, 16) arranged so as to guide the leg, each slider (60, 62) of the at least one slider pair being formed of at least one sheet metal tab (50, 52) bent out of the plate plane of the driver plate, the at least one sheet metal tab being covered with an injection molded material, and a sheet metal web (54) bent out of the plate plane and arranged so as to connect together the at least one sheet metal tab of each slider, the sheet metal tabs and the sheet metal web sharing a bending edge (58).

2. A driver according to claim 1, wherein the sheet metal web (54) projects over the driver plate (40) by an amount corresponding to the thickness (b) of the driver plate.

3. A driver according to claim 1, wherein the sheet metal web (54) is covered with an injection molded material.

4. A driver according to claim 3, wherein the sheet metal web (54) and the two sheet metal tabs (50, 52) are jointly covered with the injection molded material.

5. A driver according to claim 4, wherein at least one (62) of the two sliders (60, 62) is strengthened by means of an additional sheet metal tab (70) which is bent out of the plate plane.

6. A driver according to claim 5, wherein the additional sheet metal tab (70) has a bending edge arranged so as to extend substantially parallel to the bending edge (58) of the sheet metal web (54).

7. A driver according to claim 6, wherein the at least one slider (62) and the additional sheet metal tab (70) are jointly covered with an injection molded material.

* * * * *

UNITED STATES PATENT AND TRADEMARK OFFICE

CERTIFICATE OF CORRECTION

PATENT NO. : 4,888,916

DATED : December 26, 1989

INVENTOR(S) : Hans-Peter Hess et al

It is certified that error appears in the above-identified patent and that said Letters Patent is hereby corrected as shown below:

On the title page;

[73] Assignee: Brose Fahrzeugteile GmbH & Co. Kommanditgesellschaft, Coburg, Fed. Rep. of Germany

Signed and Sealed this

Fourth Day of December, 1990

*Attest:*

HARRY F. MANBECK, JR.

*Attesting Officer*

*Commissioner of Patents and Trademarks*